US006719409B2

(12) United States Patent
Sasaki et al.

(10) Patent No.: US 6,719,409 B2
(45) Date of Patent: Apr. 13, 2004

(54) INK JET PRINTER HEAD AND PIEZOELECTRIC ACTUATOR FOR THE HEAD

(75) Inventors: Yasuhiro Sasaki, Tokyo (JP); Hirofumi Nakamura, Tokyo (JP); Atsushi Ochi, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 162 days.

(21) Appl. No.: 10/059,184

(22) Filed: Jan. 31, 2002

(65) Prior Publication Data

US 2002/0149653 A1 Oct. 17, 2002

(30) Foreign Application Priority Data

Jan. 31, 2001 (JP) ..... 2001-023902

(51) Int. Cl.[7] ..... B41J 2/045
(52) U.S. Cl. ..... 347/70
(58) Field of Search ..... 347/68, 70, 71; 310/368, 369, 328; 29/25.35, 890.1

(56) References Cited

U.S. PATENT DOCUMENTS 6,088,893 A * 7/2000 Takeuchi et al. ..... 29/25.35
6,550,897 B2 * 4/2003 Nakamura et al. ..... 347/68

OTHER PUBLICATIONS

By T. Katakura, "Technology to Make Ink Jet Printer Head High Performance" Ultrasonic Wave Techno, 1998, pp. 33–36.

* cited by examiner

*Primary Examiner*—Judy Nguyen
(74) *Attorney, Agent, or Firm*—Young & Thompson

(57) ABSTRACT

An ink jet printer head and a piezoelectric actuator for the head, in which energy conversion efficiency from an electric energy to a mechanical vibration energy is high, and its mechanical displacement of a vibration transferring plate is large, are provided. An ink jet printer head having a piezoelectric actuator provides an upper electrode, a piezoelectric plate, a lower electrode, a vibration transferring plate, and a pressure chamber, whose shape is a rectangle and its length ratio of the short side to the long side is 0.8 or more and 1.0 or less. And the piezoelectric plate having the lower electrode is bonded to the vibration transferring plate at a position within the inside wall of the pressure chamber and the center positions of the piezoelectric plate and the pressure chamber are set to be almost equal. Therefore, the energy conversion efficiency of the piezoelectric plate can be utilized in its maximum, and the piezoelectric actuator whose mechanical displacement is large can be realized. Consequently, the industrial value of the ink jet printer head becomes large by applying the piezoelectric actuator to an ink jet printer.

21 Claims, 9 Drawing Sheets

C–C' CROSS-SECTION

D–D' CROSS-SECTION (a)

(b)

(c)

INK JET PRINTER HEAD AND PIEZOELECTRIC ACTUATOR FOR THE HEAD

BACKGROUND OF THE INVENTION

The present invention relates to an ink jet printer head and a piezoelectric actuator for the head, in particular, in which ink filled in a pressure chamber is jetted by converting an electric energy into a mechanical vibration energy in high efficiency.

DESCRIPTION OF THE RELATED ART

Conventionally, a piezoelectric actuator, in which a vibration transferring plate and a piezoelectric plate having a characteristic, which is expanded and contracted by applying a voltage, are unified, has been developed and used for an ink jet printer head and a pressure pump. The piezoelectric actuator for the ink jet printer head is classified into two types. In one type, a vertical vibration of the piezoelectric plate is used, and in the other type, bending, which is generated by the vibration of the piezoelectric plate unified the vibration transferring plate, is used.

For example, a technical report, written by T. Katakura, "Technology to Make Ink Jet Printer Head High Performance " Ultrasonic Wave TECHNO, 1998, pp. 33–36, describes a structure of an ink jet printer head used a piezoelectric actuator and its ink jet theory in detail.

FIG. 1 is a perspective view showing a structure of this conventional ink jet printer head and its piezoelectric actuator for this head. As shown in FIG. 1, this conventional ink jet printer head used the piezoelectric actuator consists of an upper electrode 91, a piezoelectric plate 92, a lower electrode 93, a vibration transferring plate 94, and a pressure chamber 95.

An electric energy applied to the piezoelectric actuator is converted into a mechanical vibration energy by the upper electrode 91, the piezoelectric plate 92, and the lower electrode 93. This mechanical vibration energy is transferred to liquid ink filled in the pressure chamber 95 via the vibration transferring plate 94, and is converted into an acoustic energy. This acoustic energy is converted into a kinetic energy, which is required to make ink drops hit paper, at a small hole provided on the surface of a printer head. The kinetic energy makes the ink drops jet the paper. The amount of this kinetic energy depends on the size of the mechanical displacement, generated by the mechanical vibration energy by the piezoelectric actuator, of the vibration transferring plate 94.

At the piezoelectric actuator, it is required that the energy conversion efficiency from the electric energy to the mechanical vibration energy is high, that is, it is required that the mechanical displacement of the vibration transferring plate 94 is large. This energy conversion efficiency is shown as follows: the energy conversion efficiency=the mechanical vibration energy/the applied electric energy. The larger the energy conversion efficiency is, the bigger the mechanical displacement becomes. Therefore, as shown in FIG. 1, the piezoelectric actuator, which consists of the vibration transferring plate 94, the lower electrode 93 formed on the vibration transferring plate 94, and the piezoelectric plate 92 having a long rectangle shape, disposed on the lower electrode 93, and the upper electrode 91 formed on the piezoelectric plate 92, is generally used.

However, at the conventional piezoelectric actuator mentioned above, the expanding and contracting movement in the width direction of the piezoelectric plate 92 is mainly used, and the expansion and contraction in the length direction does not contribute to the vibration. Consequently, the energy conversion efficiency from the applied electric energy to the mechanical vibration energy is very low. That is, there is a problem that the kinetic energy being sufficient to jet liquid ink cannot be obtained, because the mechanical displacement of the vibration transferring plate 94 is small.

SUMMARY OF THE INVENTION

It is therefore an object of the present invention to provide an ink jet printer head and a piezoelectric actuator for the head, in which energy conversion efficiency from an electric energy to a mechanical vibration energy is high, and its mechanical displacement of a vibration transferring plate is large. Further, by using the piezoelectric actuator of the present invention, it is easily possible to realize a thin-sized and efficient pressure pump for the ink jet printer head.

According to a first aspect of the present invention for achieving the object mentioned above, there is provided an ink jet printer head. The ink jet printer head provides a pressure chamber, which is formed in a substrate as a cavity and provides an opening part having a designated contour shape on the upper surface side of the substrate, a vibration transferring plate, which is bonded to the pressure chamber in a state that the vibration transferring plate covers the opening part, and a piezoelectric actuator, which is formed by layering a lower electrode, a piezoelectric plate, and an upper electrode on the vibration transferring plate, and includes the vibration transferring plate and a pressure chamber side wall, bonded to the vibration transferring plate, of the pressure chamber. And the designated contour shape of the opening part of the pressure chamber is a rectangle, and the length ratio of the short side to the long side of the rectangle is 0.8 or more and 1.0 or less, and the contour of the piezoelectric plate of the piezoelectric actuator is positioned within the contour shape of the opening part of the pressure chamber above the opening part.

According to a second aspect of the present invention, in the first aspect, the area of the piezoelectric plate is 0.5 or more and 1.0 or less of the area of the opening part of the pressure chamber.

According to a third aspect of the present invention, in the second aspect, the piezoelectric plate having the lower electrode is formed on the vibration transferring plate at the position where the center position of the piezoelectric plate is made to be almost equal to the center position of the opening part of the pressure chamber.

According to a fourth aspect of the present invention, in the third aspect, the contour of the piezoelectric plate is a rectangle.

According to a fifth aspect of the present invention, in the fourth aspect, the contour of the piezoelectric plate is a similarity rectangle to the contour shape of the opening part of the pressure chamber.

According to a sixth aspect of the present invention, in the fifth aspect, the contour of the piezoelectric plate is an almost equal shape to the contour shape of the opening part of the pressure chamber.

According to a seventh aspect of the present invention, in the third aspect, the contour of the piezoelectric plate is a circle.

According to an eighth aspect of the present invention, in the seventh aspect, at least a part of the circumference of the circular contour of the piezoelectric plate having the lower electrode is positioned within the contour shape of the opening part of the pressure chamber, by disposing the vibration transferring plate between the piezoelectric plate having the lower electrode and the pressure chamber.

According to a ninth aspect of the present invention, in the seventh aspect, the circular contour of the piezoelectric plate having the lower electrode is positioned within the contour shape of the opening part of the pressure chamber, by disposing the vibration transferring plate between the piezoelectric plate having the lower electrode and the pressure chamber.

According to a tenth aspect of the present invention, in the third aspect, the contour of the piezoelectric plate is an ellipse.

According to an eleventh aspect of the present invention, in the tenth aspect, at least a part of the ellipse contour of the piezoelectric plate having the lower electrode is positioned within the contour shape of the opening part of the pressure chamber, by disposing the vibration transferring plate between the piezoelectric plate having the lower electrode and the pressure chamber.

According to a twelfth aspect of the present invention, in the tenth aspect, the ellipse contour of the piezoelectric plate having the lower electrode is positioned within the contour shape of the opening part of the pressure chamber, by disposing the vibration transferring plate between the piezoelectric plate having the lower electrode and the pressure chamber.

According to a thirteenth aspect of the present invention, in the first aspect, the vibration transferring plate has a concave part or concave parts close to the edge part of the opening part of the pressure chamber.

According to a fourteenth aspect of the present invention, in the thirteenth aspect, the area of the concave part(s) is less than 0.5 of the area of the opening part of the pressure chamber.

According to a fifteenth aspect of the present invention, in the thirteenth aspect, the concave part(s) is a groove(s), which is formed along the contour of the vibration transferring plate in a state that the groove(s) is positioned at a place having a designated width from the contour of the vibration transferring plate.

According to a sixteenth aspect of the present invention, in the fifteenth aspect, the shape of the center part of the vibration transferring plate, surrounded by the groove, is a rectangle.

According to a seventeenth aspect of the present invention, in the fifteenth aspect, the shape of the center part of the vibration transferring plate, surrounded by the groove, is a circle or an ellipse.

According to an eighteenth aspect, in the thirteenth aspect, the grooves are formed at least four positions being rotation symmetry along the contour of the vibration transferring plate.

According to a nineteenth aspect of the present invention, in the eighteenth aspect, the grooves are formed along each side of the vibration transferring plate on the surface, which is bonded to the pressure chamber, of the vibration transferring plate.

According to a twentieth aspect of the present invention, in the eighteenth aspect, the grooves are formed in a ∟ shape along each corner of the vibration transferring plate on the surface, which is bonded to the pressure chamber, of the vibration transferring plate.

According to a twenty-first aspect of the present invention, in the thirteenth aspect, a part or plural parts of the concave part(s) are connected to an ink supplying hole in the pressure chamber.

According to a twenty-second aspect of the present invention, there is provided a piezoelectric actuator for an ink jet printer head. The piezoelectric actuator for the ink jet printer head provides an upper electrode, a lower electrode, a piezoelectric plate disposed between the upper and lower electrodes, a vibration transferring plate bonded to the piezoelectric plate having the lower electrode, and a pressure chamber side wall being a part of a pressure chamber and bonded to the vibration transferring plate. And an opening part, which is covered with the vibration transferring plate, of the pressure chamber is a rectangle, and the length ratio of the short side to the long side of the rectangle is 0.8 or more and 1.0 or less, and the piezoelectric plate having the lower electrode is bonded to the vibration transferring plate within the contour of the opening part of the pressure chamber above the opening part.

According to a twenty-third aspect of the present invention, in the twenty-second aspect, the area of the piezoelectric plate is 0.5 or more and 1.0 or less of the area of the opening part of the pressure chamber.

According to a twenty-fourth aspect of the present invention, in the twenty-third aspect, the piezoelectric plate having the lower electrode is formed on the vibration transferring plate at the position where the center position of the piezoelectric plate is made to be almost equal to the center position of the opening part of the pressure chamber.

According to a twenty-fifth aspect of the present invention, in the twenty-fourth aspect, the contour of the piezoelectric plate is a rectangle.

According to a twenty-sixth aspect of the present invention, in the twenty-fifth aspect, the contour of the piezoelectric plate is a similarity rectangle to the contour shape of the opening part of the pressure chamber.

According to a twenty-seventh aspect of the present invention, in the twenty-sixth aspect, the contour of the piezoelectric plate is an almost equal shape to the contour shape of the opening part of the pressure chamber.

According to a twenty-eighth aspect of the present invention, in the twenty-fourth aspect, the contour of the piezoelectric plate is a circle.

According to a twenty-ninth aspect of the present invention, in the twenty-eighth aspect, at least a part of the circumference of the circular contour of the piezoelectric plate having the lower electrode is positioned within the contour shape of the opening part of the pressure chamber, by disposing the vibration transferring plate between the piezoelectric plate having the lower electrode and the pressure chamber.

According to a thirtieth aspect of the present invention, in the twenty-eighth aspect, the circular contour of the piezoelectric plate having the lower electrode is positioned within the contour shape of the opening part of the pressure chamber, by disposing the vibration transferring plate between the piezoelectric plate having the lower electrode and the pressure chamber.

According to a thirty-first aspect of the present invention, in the twenty-fourth aspect, the contour of the piezoelectric plate is an ellipse.

According to a thirty-second aspect of the present invention, in the thirty-first aspect, at least a part of the ellipse contour of the piezoelectric plate having the lower electrode is positioned within the contour shape of the opening part of the pressure chamber, by disposing the vibration transferring plate between the piezoelectric plate having the lower electrode and the pressure chamber.

According to a thirty-third aspect of the present invention, in the thirty-first aspect, the ellipse contour of the piezoelectric plate having the lower electrode is positioned within the contour shape of the opening part of the pressure chamber, by disposing the vibration transferring plate between the piezoelectric plate having the lower electrode and the pressure chamber.

According to a thirty-fourth aspect of the present invention, in the twenty-second aspect, the vibration transferring plate has a concave part or concave parts close to the edge part of the opening part of the pressure chamber.

According to a thirty-fifth aspect of the present invention, in the thirty-fourth aspect, the area of the concave part(s) is less than 0.5 of the area of the opening part of the pressure chamber.

According to a thirty-sixth aspect of the present invention, in the thirty-fourth aspect, the concave part(s) is a groove(s), which is formed along the contour of the vibration transferring plate in a state that the groove(s) is positioned at a place having a designated width from the contour of the vibration transferring plate.

According to a thirty-seventh aspect of the present invention, in the thirty-sixth aspect, the shape of the center part of the vibration transferring plate, surrounded by the groove, is a rectangle.

According to a thirty-eighth aspect of the present invention, in the thirty-sixth aspect, the shape of the center part of the vibration transferring plate, surrounded by the groove, is a circle or an ellipse.

According to thirty-ninth aspect of the present invention, in the thirty-fourth aspect, the grooves are formed at least four positions being rotation symmetry along the contour of the vibration transferring plate.

According to a fortieth aspect of the present invention, in the thirty-ninth aspect, the grooves are formed along each side of the vibration transferring plate on the surface, which is bonded to the pressure chamber, of the vibration transferring plate.

According to a forty-first aspect of the present invention, in the thirty-ninth aspect, the grooves are formed in a ∟ shape along each corner of the vibration transferring plate on the surface, which is bonded to the pressure chamber, of the vibration transferring plate.

According to a forty-second aspect of the present invention, in the thirty-fourth aspect, a part or plural parts of the concave part(s) are connected to an ink supplying hole in the pressure chamber.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Figure 1:
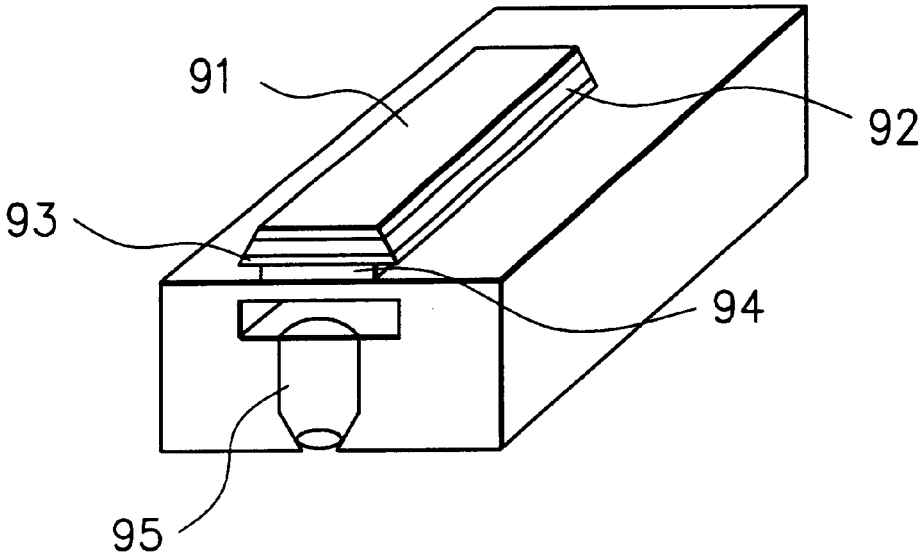
FIG. 1 PRIOR ART
FIG. 1 is a perspective view showing a structure of a conventional ink jet printer head and its piezoelectric actuator for the head.
Figure 2:
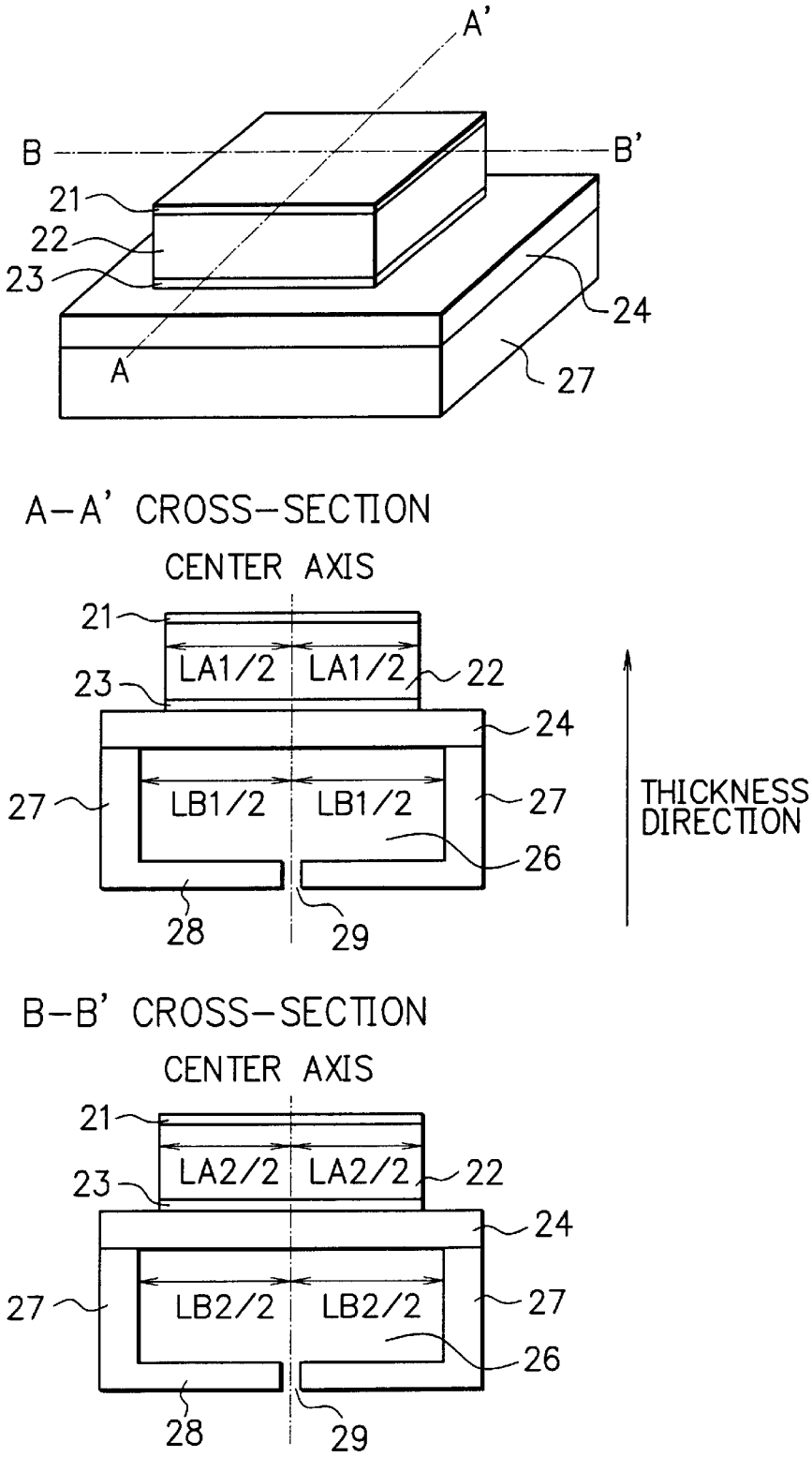
FIG. 2 is a perspective view and sectional views showing a structure of an ink jet printer head and a piezoelectric actuator for the head at a first embodiment of the present invention.

Referring now to the drawings, embodiments of the present invention are explained in detail. FIG. 2 is a perspective view and sectional views showing a structure of an ink jet printer head and a piezoelectric actuator for the head at a first embodiment of the present invention. As shown in FIG. 2, a piezoelectric actuator for an ink jet printer head consists of an upper electrode 21, a piezoelectric plate 22, a lower electrode 23, a vibration transferring plate 24, and a pressure chamber side wall 27.

The pressure chamber 26 is formed as a cavity in a substrate, and provides an opening part having a designated shape on the upper surface of the substrate. And also the pressure chamber 26 can be formed by the pressure chamber side wall 27 and a pressure chamber bottom wall 28. In the present invention, the contour shape of this opening part is a rectangle whose length ratio of the short side to the long side is 0.8 or more and 1.0 or less. This substrate is made of various materials such as a single crystalline wafer like single crystalline silicon and an amorphous material like glass. In case that a single crystalline silicon (100) wafer is used to form the substrate, it is possible to form the opening part having the rectangular shape by wet etching easily, and this is suitable to form the pressure chamber 26.

At the pressure chamber bottom wall 28, that is, at the opposite side of the opening part of the pressure chamber 26, a nozzle hole 29 from which ink is jetted is provided. Or a nozzle plate having a nozzle hole is bonded to the pressure chamber side wall 27, and the pressure chamber 26 is formed.

The vibration transferring plate 24 is bonded to the substrate so that the opening part of the pressure chamber 26 provided on the substrate is covered with the vibration transferring plate 24. The piezoelectric actuator is formed by layering the lower electrode 23, the piezoelectric plate 22, and the upper electrode 21 in this order on the vibration transferring plate 24, and by bonding to the pressure chamber side wall 27. This piezoelectric plate 22 is disposed on the position where the contour of the piezoelectric plate 22 is within the contour of the opening part of the pressure chamber 26, above the pressure chamber 26. The position of the piezoelectric actuator is explained in more detail later.

The upper electrode 21 and the lower electrode 23 are made of a metal, a conductive resin, or a conductive ceramics. The piezoelectric plate 22 is made of a material, which is expanded and contracted by applying a voltage, such as a polyvinylideue fluoride resin, a lead zirconate-lead titanate ceramics or a lead zirconate-lead titanate single crystal, and a composite material formed by these resin, ceramics and single crystal.

The piezoelectric plate 22 provides a piezoelectric transducer that is expanded and contracted by applying a voltage. In case that this piezoelectric plate 22 is formed by a ceramics by sintering lead zirconate-lead titanate whose main component is lead, when a higher melting point material than that of the vibration transferring plate 24 is used, the diffusion of the lead and other components to the vibration transferring plate 24 is prevented. Therefore, the characteristics of the vibration transferring plate 24 can be prevented from deteriorating.

Further, the composition of materials of the piezoelectric plate 22 is kept in uniform, and stable vibration characteristics can be obtained, by preventing the lead and other components from diffusing. And in case that a Pb type ceramics like lead titanatte is used for the vibration transferring plate 24, the evaporation of the lead at sintering the piezoelectric plate 22 can be prevented. Therefore, the piezoelectric plate 22, whose composition of materials is uniform, can be formed.

The vibration transferring plate 24 is made of an organic material like a resin, a ceramics, glass, a metal, or a single crystalline material. In case that a resin is used for forming the vibration transferring plate 24, the boundary de-lamination caused by the thermal expansion generated at manufacturing processes can be prevented by the elasticity of the resin, at the time when the vibration transferring plate 24 is bonded to the piezoelectric plate 22 having the lower electrode 23.

In case that the vibration transferring plate 24 is made of a ceramics, whose main components are zirconia, alumina, magnesia, and titania, and melting point is higher than the material of the piezoelectric plate 22, it becomes possible that the piezoelectric plate 22 is formed on the vibration transferring plate 24, in which the lower electrode 23 was formed, as a unified unit by firing. Therefore, the piezoelectric actuator unified with the vibration transferring plate 24 can be manufactured, without using a bonding material like an adhesive.

In case that the vibration transferring plate 24 is formed by layering a metal, a ceramics, glass, and an organic material, or is formed by the composite of those materials, the degree of freedom of the elastic modulus of the vibration transferring plate 24 can be expanded. Therefore, a piezoelectric actuator, which can obtain necessary mechanical displacement corresponding to its purpose, can be realized.

When the vibration transferring plate 24 is made of a metal, this metal can be also used as the lower electrode 23. Consequently, it is not necessary to form the lower electrode 23 newly, and its manufacturing cost can be reduced.

In case that the vibration transferring plate 24 is made of a single crystal like silicon, alumina, and magnesia, the vibration transferring plate 24 with a high accurate size can be manufactured by applying fine manufacturing processes used at a semiconductor manufacturing processes.

When the upper electrode 21 and the lower electrode 23 are made of a low resistance value metal material, such as Au, Cu, Pt, Ag, and an alloy of Ag and Pd, an electric energy loss at the time when a voltage is applied to the piezoelectric actuator can be made to be low. Therefore, the heating of the piezoelectric actuator itself can be prevented.

Generally, the piezoelectric plate 22 has some capacitance, and its capacitance changes when the operating temperature becomes high. By this change of the capacitance, a current flowing into the piezoelectric actuator changes. Consequently, there was a problem that controlling the piezoelectric actuator became difficult. However, the current change caused by the operating temperature can be prevented by using the low resistance value metal material for the upper and lower electrodes 21 and 23. And the controllability of the piezoelectric actuator can be improved. Therefore, an actually usable piezoelectric actuator can be realized by using the materials mentioned above.

The piezoelectric plate 22 can be made by a mechanical process as a thin plate, and the upper and lower electrodes 21 and 23 are formed on this piezoelectric plate 22. And the piezoelectric actuator is formed with the vibration transferring plate 24 on the upper electrode 21, the piezoelectric plate 22, and the lower electrode 23 as a unified unit by using an adhesive, such as an organic adhesive, a metal bonding material, and a glass adhesive material, with the pressure chamber side wall 27. The piezoelectric actuator has fine and uniform composition and an accurate size, compared with that is formed by firing as a unified unit. Therefore, an ideal piezoelectric actuator having the essential characteristics of a piezoelectric plate can be realized At the piezoelectric actuator for the ink jet printer head of the present invention, when an electric energy is given to the piezoelectric plate 22 disposed between the upper and lower electrodes 21 and 23, the expanding and contracting vibration of the piezoelectric plate 22 is generated. This expanding and contracting movement is converted into a bending vibration by the constraint of the vibration transferring plate 24. And the mechanical displacement of the piezoelectric actuator for the ink jet printer head is generated in the thickness direction of the piezoelectric actuator.

In case that it is set that the shape of the piezoelectric plate 22 is rectangular, the piezoelectric vibrations in the width and length directions are coupled, as the side ratio of the width to the length of the piezoelectric plate 22 becomes close to 1. That is, the piezoelectric coupling is generated, and the piezoelectric plate 22 having the upper and lower electrodes 21 and 23 is vibrated symmetrically in the contour directions of the piezoelectric plate 22 as the center axis of the piezoelectric plate 22 is its center. This vibration energy at this time is amplified by coupling the two piezoelectric vibrations. The expanding and contracting movement of the piezoelectric actuator unified the piezoelectric plate 22 having the upper and lower electrodes 21 and 23, the vibration transferring plate 24, and the pressure chamber side wall 27 is converted into a large bending vibration, because the expanding and contracting direction is changed by the constraint of the vibration transferring plate 24.

Figure 3:
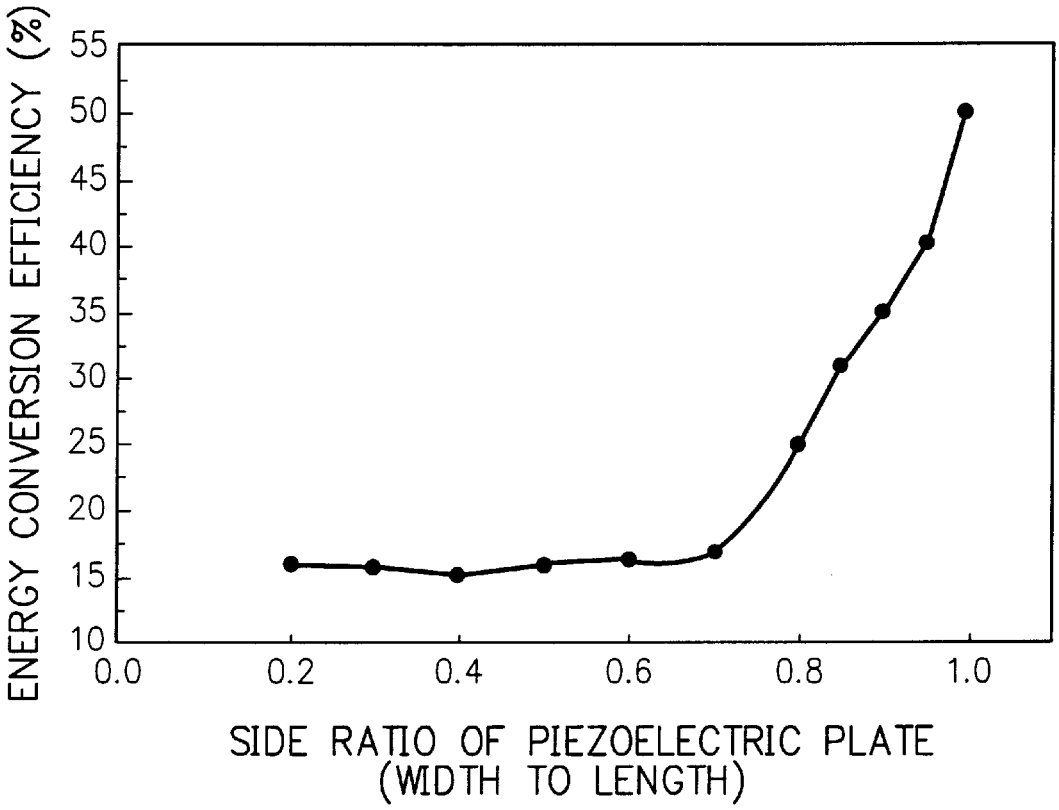
FIG. 3 is a graph showing a relation between the energy conversion efficiency and the side ratio of the width to the length of a piezoelectric plate at embodiments of the present invention.

The conventional piezoelectric actuator used a long rectangular piezoelectric plate utilizes only the expanding and contracting movement by the piezoelectric vibration in the width direction mainly. Therefore, the energy conversion efficiency from the electric energy to the mechanical vibration energy is low, that is, the generating mechanical displacement is small. FIG. 3 is a graph showing a relation between the energy conversion efficiency and the side ratio of the width to the length of the piezoelectric plate 22 at the embodiments of the present invention. As shown in FIG. 3, the energy conversion efficiency is about 15 to 17%, at the side ratio is 0.2 to 0.7, and the energy conversion efficiency becomes large rapidly at the side ration is about 0.8 to 1.0, and reaches about 50% being maximum at the side ratio is 1.0.

Next, the relation between the contour of the piezoelectric plate 22 and the contour of the inside wall of the pressure chamber 26 is explained. In case that the contour of the piezoelectric plate 22 is larger than the contour of the inside wall of the pressure chamber 26, the expanding and contracting movement of the piezoelectric plate 22 is constrained by the area difference between the contours of them. Therefore, the bending vibration of the piezoelectric plate 22 is constrained extremely. That is, in case that the contour of the piezoelectric plate 22 is equal to or smaller than the contour of the inside wall of the pressure chamber 26, the constraint caused by the stiffness of the pressure chamber 26 does not occur. And large mechanical displacement reaching the 50% of the area surrounded by the contour of the inside wall of the pressure chamber 26 can be obtained.

However, when the area of the piezoelectric plate 22 is smaller than the 50% of the area surrounded by the contour of the inside wall of the pressure chamber 26, the mechanical vibration energy being sufficient to bend the vibration transferring plate 24 is not obtained, and the mechanical displacement of the vibration transferring plate 24 becomes small. Further, if the center of the pressure chamber 26 is not equal to the center of the piezoelectric plate 22, the mechanical displacement being symmetry for the center cannot be obtained. And the mechanical displacement distribution of the vibration transferring plate 24 does not become uniform, and the average value of the mechanical displacement of the vibration transferring plate 24 becomes small.

The inside shape of the pressure chamber 26 dose not always become a designated shape caused by the dispersion at the manufacturing processes and a part remained at the etching. Therefore, in the present invention, the embodiments are explained as the bonding surface of the pressure chamber 26 and the vibration transferring plate 24 is made to be a reference surface.

Figure 4:
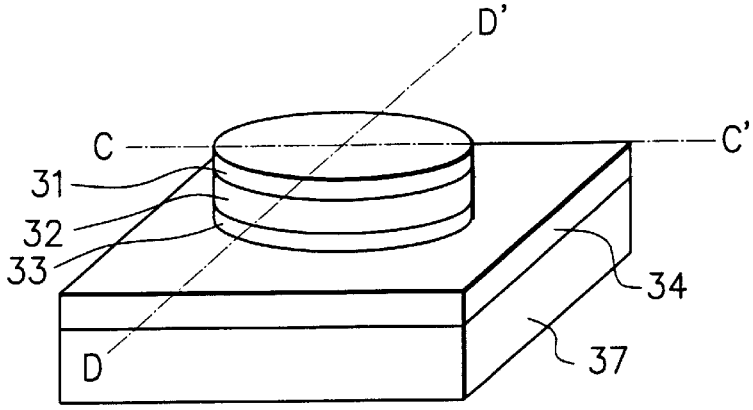
FIG. 4 is a perspective view and sectional views showing a structure of an ink jet printer head and a piezoelectric actuator for the head at a second embodiment of the present invention.
Figure 4:
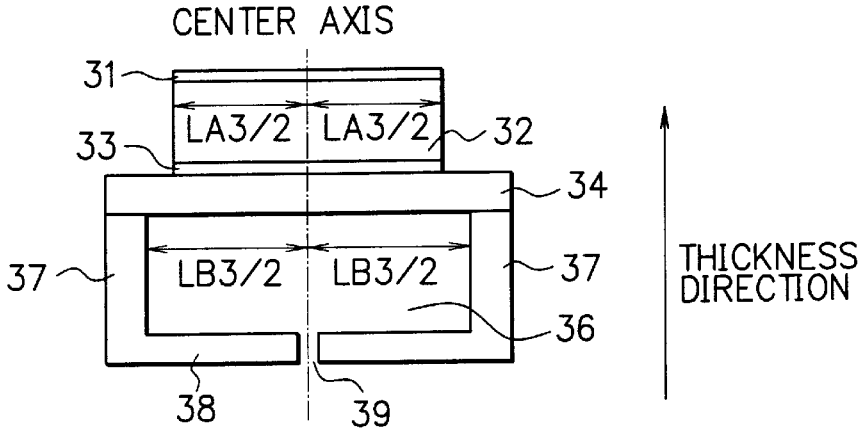
Figure 4:
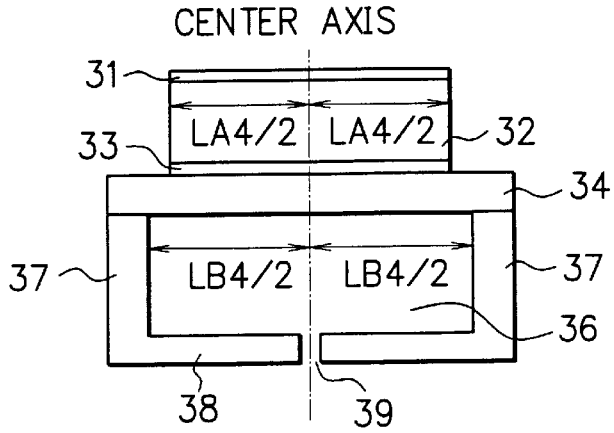
Figure 5:
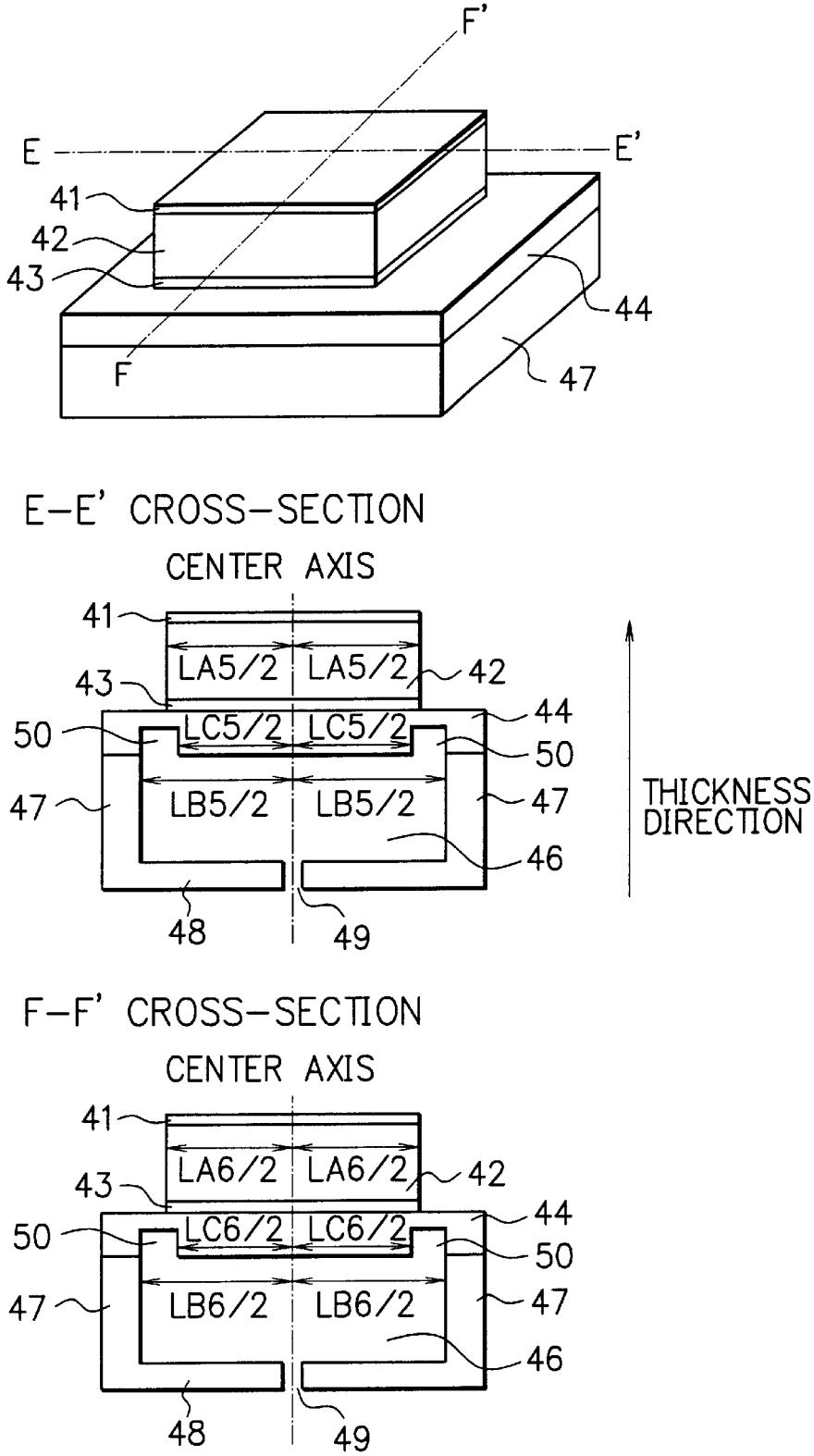
FIG. 5 is a perspective view and sectional views showing a structure of an ink jet printer head and a piezoelectric actuator for the head at a third embodiment of the present invention.
Figure 6:
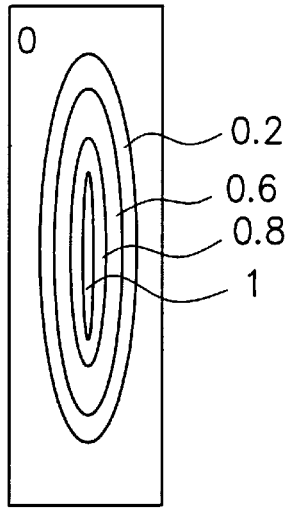
FIG. 6 is a diagram showing mechanical displacement distributions on a vibration transferring plate being one of the components of the ink jet printer head in the embodiments of the present invention.
Figure 6:
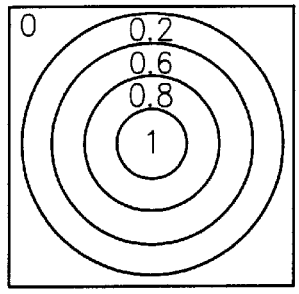
Figure 6:
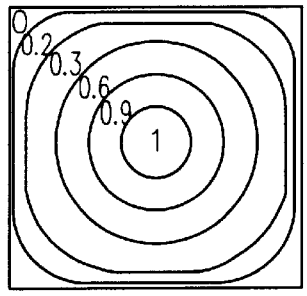

FIG. 4 is a perspective view and sectional views showing a structure of an ink jet printer head and a piezoelectric actuator for the head at a second embodiment of the present invention. FIG. 5 is a perspective view and sectional views showing a structure of an ink jet printer head and a piezoelectric actuator for the head at a third embodiment of the present invention. And FIG. 6 is a diagram showing the mechanical displacement distributions on a vibration transferring plate being one of the components of the ink jet printer head in the embodiments of the present invention. In FIG. 6, the mechanical displacement distributions of the vibration transferring plate in the thickness direction generated by the bending vibration of the piezoelectric actuator are shown in their maximum mechanical displacement as their standardized patterns.

First, the first embodiment of the ink jet printer head and the piezoelectric actuator for the head of the present invention is explained in more detail. As shown in FIG. 2, a first case, in which the lengths LA1=LB1, and LA2=LB2, and the LA2/LA1=LB2/LB1=0.3, is explained. That is, the piezoelectric actuator having a rectangular shape is explained. As shown in FIG. 6 (*a*), the mechanical displacement distribution in the thickness direction on the vibration transferring plate 24 in the piezoelectric actuator is centered on the part near the center, and especially the mechanical displacement in the length direction is zero or small. The average mechanical displacement calculated by this mechanical displacement distribution is small.

Next, in FIG. 2, a second case, in which the lengths LA1=LB1=LA2=LB2, that is, the piezoelectric actuator having a square shape is explained. In this second case, as shown in FIG. 6 (*b*), the mechanical displacement distribution is spread as concentric circles, and the average mechanical displacement is larger than that in the first case. The reason, why the average mechanical displacement becomes larger, is that the energy conversion efficiency becomes high by generating the piezoelectric coupling between in the width and length direction vibrations of the piezoelectric plate 22. However, regions, where the mechanical displacement is zero or very small enough to be ignored, exist at the four corners of the vibration transferring plate 24. These regions are regions in which the mechanical displacement is constrained by the stiffness of the vibration transferring plate 24 and the piezoelectric plate 22.

Next, the second embodiment of the present invention is explained. As shown in FIG. 4, at the second embodiment, the inside shape of a pressure chamber 36 is a square, but the shape of a piezoelectric plate 32, which is unified with a vibration transferring plate 34, is a circle. In this, the center axes of the pressure chamber 36 and a piezoelectric actuator, in which the piezoelectric plate 32 having upper and lower electrodes 31 and 33 and the vibration transferring plate 34 are unified, and bonded to a pressure chamber side wall 37, are the same, and the lengths LA3=LA4=LB3=LB4. The piezoelectric plate 32 does not exist on the four corners of the vibration transferring plate 34, therefore, the stiffness in these corners becomes low and soft. In this structure, these four corners are contributed to the mechanical displacement by the expanding and contracting movement of the piezoelectric plate 32. Therefore, as shown in FIG. 6 (*c*), the mechanical displacement distribution is widened, and the average mechanical displacement of the vibration transferring plate 34 becomes large.

Next, referring to FIG. 5, the third embodiment of the piezoelectric actuator of the present invention is explained. As shown in FIG. 5, a vibration transferring plate 44 has a concave part 50 on the surface facing a pressure chamber 46, and this concave part 50 is formed at the position along the contour of a piezoelectric plate 42. The stiffness of this concave part 50 of the vibration transferring plate 44 becomes low and soft by the effect of this concave part 50. Consequently, the place close to the contour of the vibration transferring plate 44 contributes to the mechanical displacement, and as shown in FIG. 6 (*c*), large average mechanical displacement can be obtained.

Further, when the concave part 50 is formed at the four corners of the vibration transferring plate 44 at the positions along the inside contour of the pressure chamber 46, the same effect mentioned above can be obtained.

However, when the area, where the concave part 50 is not formed, of the vibration transferring plate 44 is less than 0.5 of the inside area of the pressure chamber 46, the stiffness of the vibration transferring plate 44 is lowered largely. Therefore, the conversion from the expanding and contracting movement of the piezoelectric plate 42 to the bending vibration of the vibration transferring plate 44 is not executed sufficiently, and the average mechanical displacement of the vibration transferring plate 44 becomes small. In the explanation mentioned above, the concave part 50 was formed on the position, which faces the pressure chamber 46, of the vibration transferring plate 44. However, the concave part 50 can be formed on the position, which faces the piezoelectric plate 42, of the vibration transferring plate 44.

Figure 7:
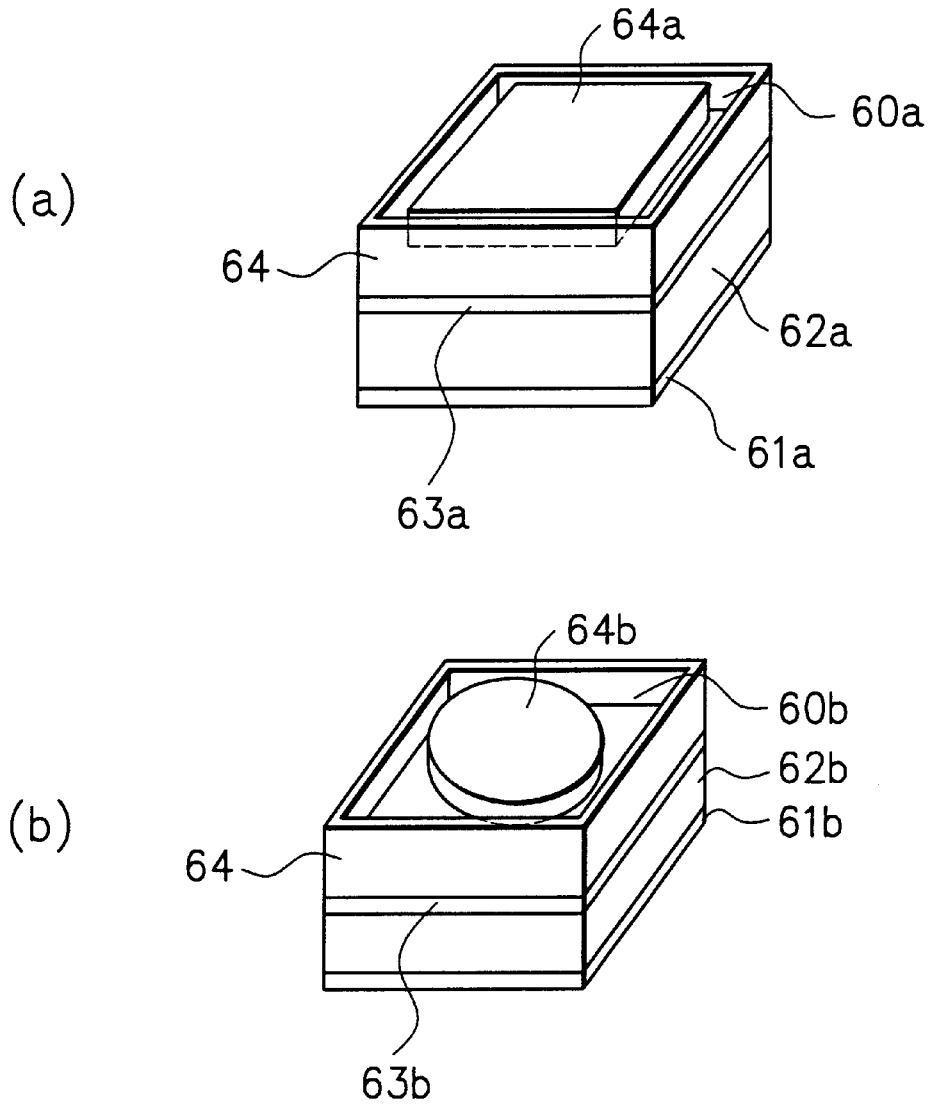
FIG. 7 is a perspective view showing a first example of the concave part of the vibration transferring plate in the piezoelectric actuator at the third embodiment of the present invention.

FIG. 7 is a perspective view showing a first example of the concave part of the vibration transferring plate in the piezoelectric actuator at the third embodiment of the present invention. In FIG. 7 (*a*), a groove 60*a* (concave part) is formed on the surface, which is bonded to a pressure chamber (not shown), of a vibration transferring plate 64. The groove 60*a* is positioned at the place where a designated width exists from the contour of the vibration transferring plate 64, and a center part 64*a* of the vibration transferring plate 64 is a rectangle. In FIG. 7 (*a*), an upper electrode 61*a*, a piezoelectric plate 62*a*, and a lower electrode 63*a* are shown.

In FIG. 7 (*b*), a center part 64*b* of the vibration transferring plate 64 is a circle, and a groove 60*b* (concave part) is formed at the part surrounding the center part 64*b* as far as the place where a designated width exists from the contour of the vibration transferring plate 64. In FIG. 7 (*b*), an upper electrode 61*b*, a piezoelectric plate 62*b*, and a lower electrode 63*b* are shown.

Figure 8:
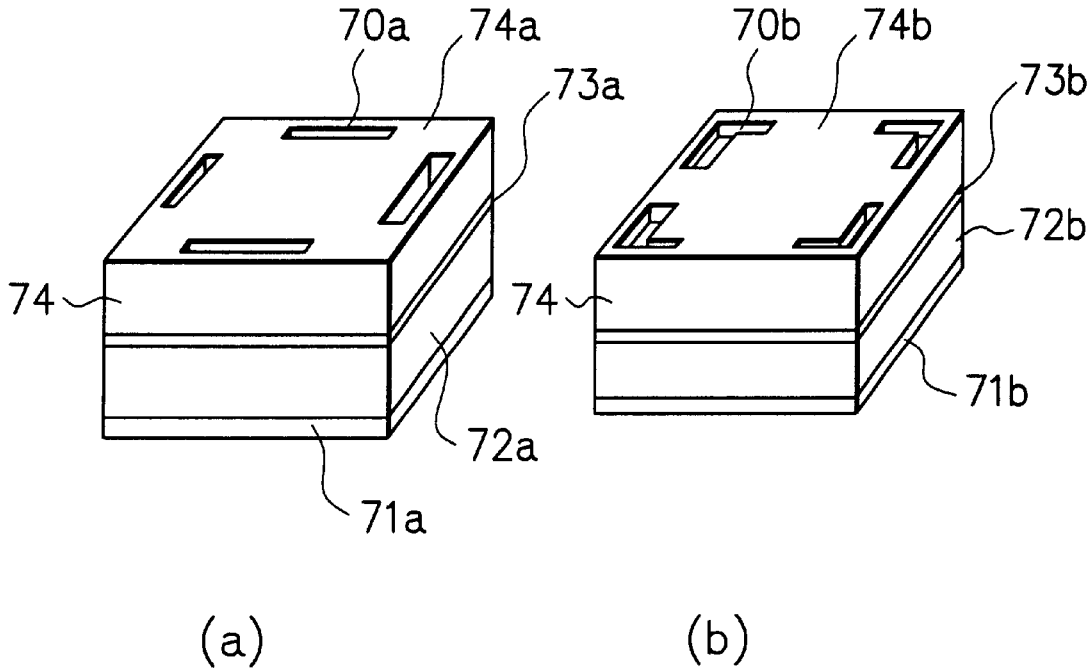
FIG. 8 is a perspective view showing a second example of the concave parts of the vibration transferring plate in the piezoelectric actuator at the third embodiment of the present invention.

FIG. 8 is a perspective view showing a second example of the concave parts of the vibration transferring plate in the piezoelectric actuator at the third embodiment of the present invention. In FIG. 8 (*a*), grooves 70*a* (concave parts) are formed on the surface, which is bonded to a pressure chamber (not shown), of a vibration transferring plate 74. The grooves 70*a* are positioned at the four places where a designated width exists from the contour of the vibration transferring plate 74, and two each of the grooves 70*a* are positioned symmetrically as the center of the vibration transferring plate 74 is made to be their center. In FIG. 8 (*a*), an upper electrode 71*a*, a piezoelectric plate 72*a*, and a lower electrode 73*a* are shown.

In FIG. 8 (*b*), ∟ shaped grooves 70*b* (concave parts) are formed on the surface, which is bonded to a pressure chamber (not shown), of the vibration transferring plate 74. The ∟ shaped grooves 70*b* are positioned at the four corners where a designated width exists from the contour of the vibration transferring plate 74, and two each of the ∟ shaped grooves 70*b* are positioned symmetrically as the center of the vibration transferring plate 74 is made to be their center. In FIG. 8 (*b*), an upper electrode 71*b*, a piezoelectric plate 72*b*, and a lower electrode 73*b* are shown.

As mentioned above, the concave part(s) is formed at the position close to the contour of the vibration transferring plate, and the stiffness at the concave part(s) becomes low. Therefore, the places close to the contour of the vibration transferring plate contribute to the mechanical displacement of the vibration transferring plate, and large mechanical displacement can be obtained.

Figure 9:
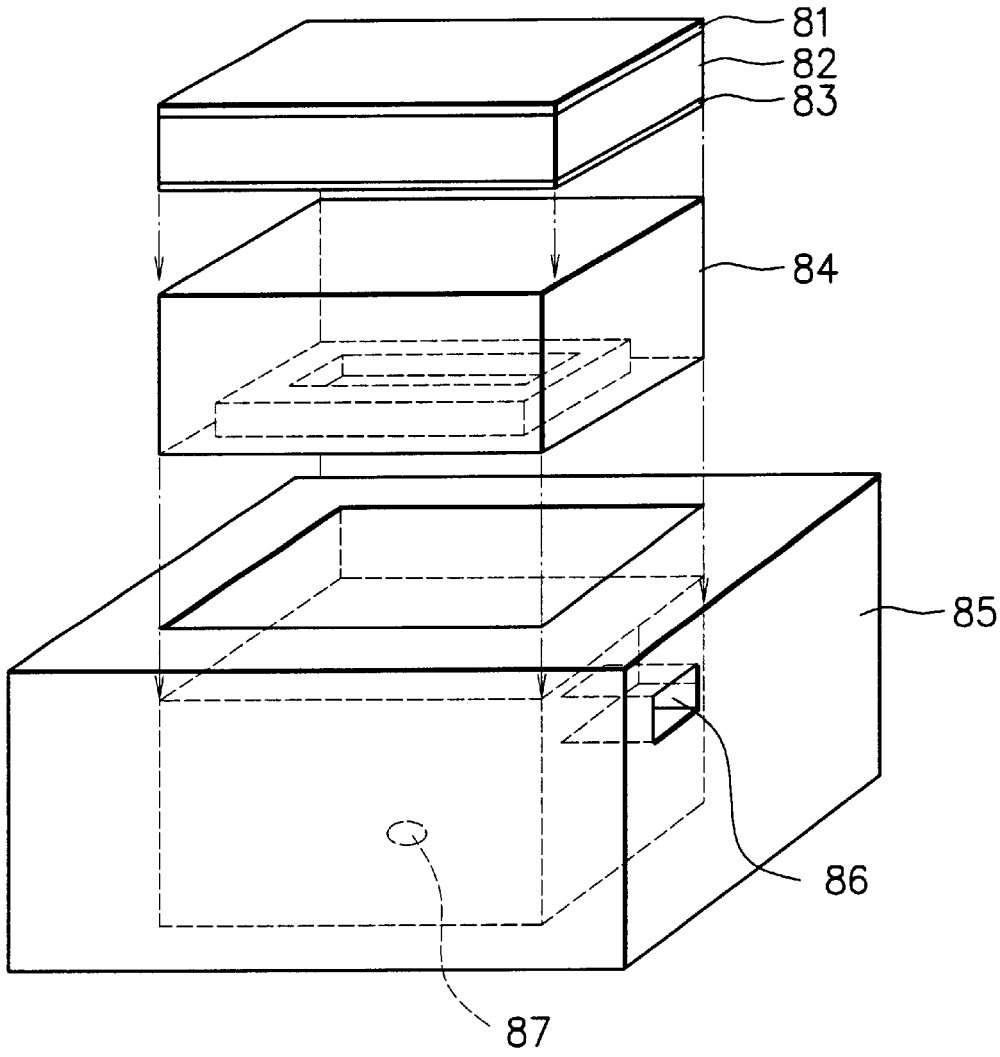
FIG. 9 is a perspective view showing a structure of an ink jet printer head used a piezoelectric actuator at an embodiment of the present invention.

FIG. 9 is a perspective view showing a structure of an ink jet printer head used a piezoelectric actuator at an embodiment of the present invention. Referring to FIG. 9, the ink jet printer head of the embodiment of the present invention is explained. As shown in FIG. 9, the ink jet printer head used the piezoelectric actuator consists of a component, in which an upper electrode 81, a piezoelectric plate 82, and a lower electrode 83 are formed, a vibration transferring plate 84 being a rectangular, in which a groove (concave part) is formed at the position where a designated width exists from the contour of the vibration transferring plate 84, and a pressure chamber 85, in which an opening part where the vibration transferring plate 84 covers, an ink supplying hole 86, and a nozzle hole 87 from which ink is jetted, are formed.

In this embodiment of the present invention, the groove (concave part) in the vibration transferring plate 84 is extended to the ink supplying hole 86 in the pressure chamber 85. With this, when ink is supplied to the pressure chamber 85 from the ink supplying hole 86, bubbles are not stayed in the pressure chamber 85 or not gathered to the four corners in the pressure chamber 85. Therefore, pressure waves in the ink generated by driving the piezoelectric actuator are transferred to the nozzle hole 87 in high efficiency.

In this, it is not always necessary to form the groove (concave part) in the vibration transferring plate 84, a vibration transferring plate without a groove can be used at the present invention.

Further, when plural pressure chambers having the piezoelectric actuator are arrayed and used for an ink jet printer, plural ink is jetted and its printing speed can become faster.

Next, referring to the drawings, actual embodiments of the present invention are explained in detail.

First, the first embodiment of the present invention is explained in more detail. In FIG. 2, at the lengths of the piezoelectric plate 22 and the inside lengths of the pressure chamber 26, it was decided that LA1=LB1, LA2=LB2, and LA1=LB1=0.4 cm, and LA1/LA2=X (variable), and a piezoelectric actuator was formed. The vibration transferring plate 24 was made of a composite ceramics of zirconia and alumina with 20 μm thickness by sintering. The lower electrode 23 was made of Pt with 2 μm thickness, and the piezoelectric plate 22 was formed by sintering a lead zirconate-lead titanate ceramics with 20 μm thickness. After this, the upper electrode 21 was formed by layering Cr with 0.1 μm thickness, Ni with 0.5 μm thickness, and Au with 1 μm thickness by a thin film forming method. And the pressure chamber side wall 27, whose thickness is 100 μm and height is 300 μm, was formed by using single crystalline silicon. At the processes mentioned above, a piezoelectric actuator was formed.

In this, in order to evaluate the piezoelectric actuator, the pressure chamber bottom wall 28 having the nozzle hole 29 was not formed. That is, as the pressure chamber 26, only the pressure chamber side wall 27 was formed. In this, as the material for forming the pressure chamber 26, that is, for forming the pressure chamber walls 27 and 28, a stainless metal, a zirconia-alumina ceramics, single crystalline silicon, single crystalline magnesia, and a single crystalline sapphire can be used. And the pressure chamber side wall 27 and the vibration transferring plate 24 were bonded by using a polyimide type adhesive. At this time, the center position of the pressure chamber 26 was made to be equal to the center position of the piezoelectric actuator. And also the contour of the pressure chamber 26 was made to be equal to the contour of the vibration transferring plate 24 at the bonding surface of them. And at the piezoelectric actuator, the lower electrode 23 was grounded and a direct current (DC) electric field 1 kV/mm was applied to the upper electrode 21 as a positive terminal. That is, the polarization process was applied to the both electrodes 21 and 23.

Next, lead elements, which do not disturb the vibration, were connected to the upper and lower electrodes 21 and 23 of the piezoelectric actuator, and an offset was applied by the DC voltage of 10 V. And the piezoelectric actuator was driven by applying an alternating current (AC) voltage of 50 kHz with amplitude of 10 V via the lead elements. The mechanical displacement distribution of the vibration transferring plate 24 was measured from the side of the pressure chamber bottom wall 28 that was not formed by using a laser mechanical displacement instrument. Table 1 shows the measured result of the average mechanical displacement Z in the variable X.

TABLE 1

| X | Z (μm) |
|---|---|
| * 0.1 | 0.065 |
| * 0.2 | 0.070 |
| * 0.3 | 0.070 |
| * 0.4 | 0.075 |
| * 0.5 | 0.080 |
| * 0.6 | 0.085 |
| * 0.7 | 0.090 |
| 0.8 | 0.210 |
| 0.9 | 0.250 |
| 1.0 | 0.300 |

In this, * are the outside regions of the present invention.

As shown in Table 1, the average mechanical displacement Z increased when the variable X is 0.8 or more, and when the variable X became 1.0, the average mechanical displacement became its maximum. That is, it is understandable that the effect of the present invention is remarkable.

Next, the second embodiment of the present invention is explained in more detail. In FIG. 4, the piezoelectric actuator was formed by the piezoelectric plate 32 having a disk shape whose diameter is the length LA3=LA4, the upper and lower electrodes 31 and 32, the vibration transferring plate 34, and the pressure chamber side wall 37. And the inside contour of the pressure chamber 36 is square, that is, LB3=LB4. In this, $\phi$=LA3 /LB3 is a variable. The vibration transferring plate 34 was made of a composite ceramics of zirconia and alumina with 20 μm thickness by sintering. The lower electrode 33 was made of Pt with 2 μm thickness, and the piezoelectric plate 32 was formed by sintering a lead zirconate-lead titanate ceramics with 20 μm. After this, the upper electrode 31 was formed by layering Cr with 0.1 μm thickness, Ni with 0.5 μm thickness, and Au with 1 μm thickness by a thin film forming method. In this, the Cr and Ni layers are provided to increase the tight contact with the piezoelectric plate 32, and the Au layer is used for conducting the current. And the pressure chamber side wall 37, whose thickness is 100 μm and height is 300 μm, was formed by using single crystalline silicon. In this, in order to evaluate the piezoelectric actuator, the pressure chamber bottom wall 38 having the nozzle hole 39 was not formed. That is, as the pressure chamber 36, only the pressure chamber side wall 37 was formed. And the vibration transferring plate 34 and the pressure chamber side wall 37 were bonded by using a polyimide type adhesive. At this time, the center position of the pressure chamber 36 was made to be equal to the center position of the piezoelectric actuator. And at the piezoelectric actuator, the lower electrode 33 was grounded and a DC electric field 1 kV/mm was applied to the upper electrode 31 as a positive terminal. That is, the polarization process was applied to the both electrodes 31 and 33.

Next, lead elements, which do not disturb the vibration, were connected to the upper and lower electrodes 31 and 33 of the piezoelectric actuator, and an offset was applied by the DC voltage of 10 V. And the piezoelectric actuator was driven by applying an AC voltage of 50 kHz with amplitude of 10 V via the lead elements. The mechanical displacement distribution of the vibration transferring plate 34 was measured from the side of the pressure chamber bottom wall 38 that was not formed by using a laser mechanical displacement instrument. Table 2 shows the measured result of the average mechanical displacement Z in the variable $\phi$.

TABLE 2

| $\phi$ | Z (μm) |
|---|---|
| *0.1 | 0.020 |
| *0.2 | 0.050 |
| *0.3 | 0.080 |
| *0.4 | 0.150 |
| *0.5 | 0.280 |
| 0.6 | 0.350 |
| 0.7 | 0.370 |
| 0.8 | 0.400 |
| 0.9 | 0.380 |
| 1.0 | 0.300 |

In this, * are the outside regions of the present invention.

As shown in Table 2, the average mechanical displacement Z was increased by about 30% at the $\phi$=0.9, compared with the piezoelectric actuator used the piezoelectric plate 22 having the square shape in the first embodiment shown in Table 1. That is, in the second embodiment, a remarkable effect was realized by using the piezoelectric plate 32 having the disk shape. And in the range between the variable $\phi$=0.6 to 0.9, the average mechanical displacement Z exceeded that at the variable $\phi$=1.0, however, the average mechanical displacement Z is lowered largely in the range $\phi \leqq 0.5$. As mentioned above, in the second embodiment, it is understandable that the range between the variable $\phi$=0.6 to 0.9 is desirable and gives a remarkable effect.

Next, the third embodiment of the present invention is explained in more detail. In FIG. 5, the piezoelectric actuator was formed with the piezoelectric plate 42 having a square shape, in which the lengths LA5=LA6. And at the inside length of the pressure chamber 46, the lengths LB5=LB6, and it was set that the LA5=LB5=LA6=LB6=0.4 cm. The vibration transferring plate 44 was made of a composite ceramics of zirconia and alumina with 20 μm by sintering. Further, in the vibration transferring plate 44, a concave part (groove), whose depth is 10 μm and width is (LB5–LC5)/2=(LB6–LC6)/2, was formed. And a variable $\gamma$=LC5/LA5 is defined by changing the LC5=LC6. The lower electrode 43 was made of Pt with 2 μm thickness, and the piezoelectric plate 42 was formed by sintering a lead zirconate-lead titanate ceramics with 20 μm thickness. After this, the upper electrode 41 was formed by layering Cr with 0.1 μm thickness, Ni with 0.5 μm thickness, and Au with 1 μm thickness by a thin film forming method. In this, the Cr and Ni layers were provided to increase the tight contact with the piezoelectric plate 42, and the Au layer is used for conducting the current.

And a pressure chamber side wall 47, whose thickness is 100 μm and height is 300 μm, was formed by using single crystalline silicon. In this, in order to evaluate the piezoelectric actuator, the pressure chamber bottom wall 48 having the nozzle hole 49 was not formed. That is, as the pressure chamber 46, only the pressure chamber side wall 47 was formed. And the vibration transferring plate 44 and the pressure chamber side wall 47 were bonded by using a polyimide type adhesive. At this time, the center position of the pressure chamber 46 was made to be equal to the center position of the piezoelectric actuator. And the contour of the piezoelectric plate 42 was made to be equal to the inside contour of the pressure chamber 46 at the boundary between the pressure chamber 46 and the vibration transferring plate 44. And at the piezoelectric actuator, the lower electrode 43 was grounded and a DC electric field 1 kV/mm was applied to the upper electrode 41 as a positive terminal. That is, the polarization process was applied to the both electrodes 41 and 43.

Next, lead elements, which do not disturb the vibration, were connected to the upper and lower electrodes 41 and 43 of the piezoelectric actuator, and an offset was applied by the DC voltage of 10 V. And the piezoelectric actuator was driven by applying an AC voltage of 50 kHz with amplitude of 10 V via the lead elements. The mechanical displacement distribution of the vibration transferring plate 44 was measured from the side of the pressure chamber bottom wall 48 that was not formed by using a laser mechanical displacement instrument. Table 3 shows the measured result of the average mechanical displacement Z in the variable γ.

TABLE 3

| γ | Z (μm) |
|---|---|
| *0.1 | 0.050 |
| *0.2 | 0.100 |
| *0.3 | 0.120 |
| *0.4 | 0.150 |
| 0.5 | 0.300 |
| 0.6 | 0.350 |
| 0.7 | 0.370 |
| 0.8 | 0.400 |
| 0.9 | 0.360 |
| 1.0 | 0.300 |

In this, * are the outside regions of the present invention.

As shown in Table 3, the average mechanical displacement Z increased at that the variable γ is 0.6 or more, compared with at the variable γ=1 being that piezoelectric actuator did not have the concave part. That is, in the third embodiment, it is understandable that a remarkable effect was realized by that the γ=0.6 to 0.9.

Next, a fourth embodiment of the present invention is explained. In FIG. 4, at the second embodiment of the present invention, the piezoelectric actuator was formed by using the piezoelectric plate 32 having the disk shape, and the pressure chamber 36 having the square shape. The diameter of the piezoelectric plate 32 was LA3=LA4, and the inside lengths of the pressure chamber 36 are LB3=LB4, and the variable ϕ=LA3/LB3. At the fourth embodiment, piezoelectric actuators were formed at the ϕ=0.5 and 0.8. The vibration transferring plate 34 was made of a composite ceramics of zirconia and alumina with 20 μm thickness by sintering. The lower electrode 33 was made of Pt with 2 μm thickness, and the piezoelectric plate 32 was formed by sintering a lead zirconate-lead titanate ceramics with 20 μm thickness. After this, the upper electrode 31 was formed by layering Cr with 0.1 μm thickness, Ni with 0.5 μm thickness, and Au with 1 μm thickness by a thin film forming method. In this, the Cr and Ni layers were provided to increase the tight contact with the piezoelectric plate 32, and the Au layer is used for conducting the current.

And the pressure chamber side wall 37, whose thickness is 100 μm and height is 300 μm, was formed by using single crystalline silicon. Further, the pressure chamber bottom wall 38 having the nozzle hole 39, whose diameter is 30 μm, was formed by using single crystalline silicon, and the pressure chamber 36 was formed. And the vibration transferring plate 34 and the pressure chamber side wall 37 were bonded by using a polyimide type adhesive. And an ink jet printer head used a piezoelectric actuator was formed. At this time, the center position of the pressure chamber 36 was made to be equal to the center position of the piezoelectric actuator. And at the piezoelectric actuator, the lower electrode 33 was grounded and a DC electric field 1 kV/mm was applied to the upper electrode 31 as a positive terminal. That is, the polarization process was applied to the both electrodes 31 and 33.

Next, lead elements, which do not disturb the vibration, were connected to the upper and lower electrodes 31 and 33 of the piezoelectric actuator, and an offset was applied by the DC voltage of 10 V. And the piezoelectric actuator was driven by applying an AC voltage of 50 kHz with amplitude of 10 V via the lead elements.

Under the conditions mentioned above, water was injected into the pressure chamber 36 instead of ink, and the velocity of water-drops jetting from the nozzle hole 39 was measured. As the result of the measurement, when the variable ϕ (LA3/LB3)=0.5, the velocity was 1 m/sec. However, when the variable ϕ=0.8, the velocity became 6 m/sec. Increasing the velocity means increasing the kinetic energy, therefore, the stability of kinetic locus of the water-drops was realized. Therefore, a high-speed printing can be executed by using the fourth embodiment of the present invention. That is, increasing the mechanical displacement at the piezoelectric actuator produces the high performance of the ink jet printer.

The embodiments of the present invention mentioned above are examples in which typical concepts of the present invention were applied. And various embodiments can be executed by using the concepts of the present invention without departing from the spirit of the present invention. For example, at the embodiments of the present invention, the shape of the piezoelectric plate is a rectangle, a square, or a disk, however, various shapes such as an ellipse can be used under the following conditions. The conditions are that the piezoelectric plate is disposed within the position of the inside wall contour of the pressure chamber at the bonding surface of the pressure chamber and the vibration transferring plate, and the center positions are the same at them, and the piezoelectric plate is formed by that the area of the piezoelectric plate is the area between 0.5 and 1.0 of the area of the inside wall contour of the pressure chamber.

According to an ink jet printer head and a piezoelectric actuator for the head of the present invention, the piezoelectric actuator, whose mechanical displacement is large, can be realized. And when this piezoelectric actuator is used for an ink jet printer, its value can be increased. Further, by using the piezoelectric actuator of the present invention, it is easily possible to realize a thin-sized and efficient pressure pump for the ink jet printer head.

Further, according to the present invention, a groove (concave part) in a vibration transferring plate is extended to an ink supplying hole in a pressure chamber. With this, when ink is supplied to the pressure chamber from the ink supplying hole, bubbles are not stayed in the pressure chamber or not gathered to the four corners in the pressure chamber. And pressure waves in the ink generated by driving the piezoelectric actuator are transferred to a nozzle hole. Therefore, the obstruction at the ink supply caused by the staying the bubbles can be prevented.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. An ink jet printer head, comprising:

a pressure chamber, which is formed in a substrate as a cavity and provides an opening part having a designated contour shape on the upper surface side of said substrate;

a vibration transferring plate, which is bonded to said pressure chamber in a state that said vibration transferring plate covers said opening part; and a piezoelectric actuator, which is formed by layering a lower electrode, a piezoelectric plate, and an upper electrode on said vibration transferring plate, wherein:

said designated contour shape of said opening part of said pressure chamber is a rectangle, and the length ratio of the short side to the long side of said rectangle is 0.8 or more and 1.0 or less, and the contour of said piezoelectric plate of said piezoelectric actuator is positioned within said contour shape of said opening part of said pressure chamber above said opening part.

2. An ink jet printer head in accordance with claim 1, wherein:

the area of said piezoelectric plate is 0.5 or more and 1.0 or less of the area of said opening part of said pressure chamber.

3. An ink jet printer head in accordance with claim 2, wherein:

said piezoelectric plate is formed on said vibration transferring plate at the position where the center position of said piezoelectric plate is made to be almost equal to the center position of said opening part of said pressure chamber.

4. An ink jet printer head in accordance with claim 3, wherein:

said contour of said piezoelectric plate is a rectangle.

5. An ink jet printer head in accordance with claim 4, wherein:

said contour of said piezoelectric plate is a similarity rectangle to said contour shape of said opening part of said pressure chamber.

6. An ink jet printer head in accordance with claim 5, wherein:

said contour of said piezoelectric plate is an almost equal shape to said contour shape of said opening part of said pressure chamber.

7. An ink jet printer head in accordance with claim 3, wherein:

said contour of said piezoelectric plate is a circle.

8. An ink jet printer head in accordance with claim 7, wherein:

at least a part of the circumference of said circular contour of said piezoelectric plate is positioned within said contour shape of said opening part of said pressure chamber, by disposing said vibration transferring plate between said piezoelectric plate and said pressure chamber.

9. An ink jet printer head in accordance with claim 7, wherein:

said circular contour of said piezoelectric plate is positioned within said contour shape of said opening part of said pressure chamber, by disposing said vibration transferring plate between said piezoelectric plate and said pressure chamber.

10. An ink jet printer head in accordance with claim 3, wherein:

said contour of said piezoelectric plate is an ellipse.

11. An ink jet printer head in accordance with claim 10, wherein:

at least a part of said ellipse contour of said piezoelectric plate is positioned within said contour shape of said opening part of said pressure chamber, by disposing said vibration transferring plate between said piezoelectric plate and said pressure chamber.

12. An ink jet printer head in accordance with claim 10, wherein:

said ellipse contour of said piezoelectric plate is positioned within said contour shape of said opening part of said pressure chamber, by disposing said vibration transferring plate between said piezoelectric plate and said pressure chamber.

13. An ink jet printer head in accordance with claim 1, wherein:

said vibration transferring plate has a concave part or concave parts close to the edge part of said opening part of said pressure chamber.

14. An ink jet printer head in accordance with claim 13, wherein:

the area of said concave part(s) is less than 0.5 of the area of said opening part of said pressure chamber.

15. An ink jet printer head in accordance with claim 13, wherein:

said concave part(s) is a groove(s), which is formed along the contour of said vibration transferring plate in a state that said groove(s) is positioned at a place having a designated width from the contour of said vibration transferring plate.

16. An ink jet printer head in accordance with claim 15, wherein:

the shape of the center part of said vibration transferring plate, surrounded by said groove, is a rectangle.

17. An ink jet printer head in accordance with claim 15, wherein:

the shape of the center part of said vibration transferring plate, surrounded by said groove, is a circle or an ellipse.

18. An ink jet printer head in accordance with claim 13, wherein:

said grooves are formed at least four positions being rotation symmetry along said contour of said vibration transferring plate.

19. An ink jet printer head in accordance with claim 18, wherein:

said grooves are formed along each side of said vibration transferring plate on the surface, which is bonded to said pressure chamber, of said vibration transferring plate.

20. An ink jet printer head in accordance with claim 18, wherein:

said grooves are formed in a ∟ shape along each corner of said vibration transferring plate on the surface, which is bonded to said pressure chamber, of said vibration transferring plate.

21. An ink jet printer head in accordance with claim 13, wherein:

a part or plural parts of said concave part(s) are connected to an ink supplying hole in said pressure chamber.

* * * * *